US010780477B2

(12) United States Patent
Ensafi et al.

(10) Patent No.: US 10,780,477 B2
(45) Date of Patent: Sep. 22, 2020

(54) SYSTEM AND METHOD OF PRODUCING NANOSTRUCTURED MATERIALS

(71) Applicants: Mahnaz Ensafi, Tehran (IR); Ghader Faraji, Tehran (IR)

(72) Inventors: Mahnaz Ensafi, Tehran (IR); Ghader Faraji, Tehran (IR)

( * ) Notice: Subject to any disclaimer, the term of this patent is extended or adjusted under 35 U.S.C. 154(b) by 358 days.

(21) Appl. No.: 15/805,087

(22) Filed: Nov. 6, 2017

(65) Prior Publication Data

US 2018/0056350 A1 Mar. 1, 2018

(51) Int. Cl.
*B21C 23/08* (2006.01)
*B21C 23/00* (2006.01)

(52) U.S. Cl.
CPC ..... *B21C 23/08* (2013.01); *B21C 23/001* (2013.01)

(58) Field of Classification Search
CPC ..... B21C 3/001; B21C 3/002; B21C 3/08; B21C 3/01
See application file for complete search history.

(56) References Cited

U.S. PATENT DOCUMENTS

| | | | | |
|---|---|---|---|---|
| 5,400,633 | A | 3/1995 | Segal et al. | |
| 5,904,062 | A | 5/1999 | Semiatin et al. | |
| 6,883,359 | B1 | 4/2005 | Hartwig, Jr. | |
| 6,895,795 | B1 * | 5/2005 | Chaudhury | B21C 23/00 72/253.1 |
| 7,096,705 | B2 | 8/2006 | Segal | |
| 2005/0081594 | A1 | 4/2005 | Segal | |

* cited by examiner

*Primary Examiner* — Debra M Sullivan
(74) *Attorney, Agent, or Firm* — NovoTechIP International PLLC

(57) ABSTRACT

An improved system and method of producing nanostructured or ultrafine grained metals is disclosed. In one embodiment, an improved system and method of producing nanostructured materials includes extruding the material through two deformation zones. The first zone consists of an inlet channel for inputting the material and a narrow channel through which the material is extruded, thus reducing its diameter. The second zone is an angular channel through which the compressed reduced diameter material is extruded to increase its diameter back to the original diameter. This eliminates the need for a dual press to provide back pressure to the material for increasing its diameter. Moreover, the total amount of strain applied to the material includes strain applied as a result of extrusion through the narrow channel and strain applied as a result of extrusion through the angular channel. As a result of the additional strain, fewer passes through the system are needed to achieve a desire strength.

14 Claims, 4 Drawing Sheets

100

400

SYSTEM AND METHOD OF PRODUCING NANOSTRUCTURED MATERIALS

CROSS REFERENCE TO RELATED APPLICATION

This application claims the benefit of priority to an Iran patent application having serial number 139550140003010082, which was filed on Nov. 11, 2016, and is incorporated by reference herein in its entirety.

TECHNICAL FIELD

The present application relates generally to severe plastic deformation (SPD), and more particularly to an improved method and system of SPD for producing nanostructured metals and alloys.

BACKGROUND

SPD refers to processes that produce ultrafine grained (UFG) metals and plastics having refined grain structures. Materials produced through these processes exhibit significant improvements in many physical and mechanical properties. The improved properties include higher strength, higher ductility, higher corrosion resistance, and/or super plasticity. As a result of these improved properties, materials produced through SPD processes are highly desirable for use in many different industries. For example, materials produced through SPD processes may have applications as structural materials in automotive, transportation, aerospace and other industries. However, despite their favorable properties, the use of such materials is not common in most industries. This is because most of the SPD processes currently available are restricted by size and are labor and time consuming and thus expensive.

Therefore, a need exists for providing an improved system and method of sever plastic deformation for producing nanostructured materials such as UFG metals that is cost effective.

SUMMARY

An improved method of producing nanostructured material is provided. In one implementation, the method of producing nanostructured material includes the steps of providing a sample of material, placing the sample of material into a first channel of an extrusion tool, where the extrusion tool includes a narrow channel and an angular channel, and a top end of the narrow channel is connected to one end of the first channel and a bottom part of the narrow channel is connected to one end of the angular channel. The method of producing nanostructured material also includes applying pressure on the sample of material to extrude the sample through the narrow channel and into the angular channel, and forcing the extruded sample of material to further extrude through the angular channel, where extrusion through the narrow channel reduces a diameter of the sample of material and extrusion through the angular channel increases the reduced diameter without a need for applying back pressure. In one implementation, the method of producing nanostructured can be utilized where the sample of material has a cylindrical shape.

A system for producing nanostructured material is provided. The system for producing nanostructured material includes an inlet channel having a first end for inputting a sample of material and a second end, a narrow channel for extruding the sample of material, the narrow channel having a top end and a bottom end, the top end being connected to the second end of the inlet channel, and an angular channel for further extruding the sample of material, the angular channel having an angular portion connected to the bottom end of the narrow channel. In one implementation, the narrow channel has a diameter which is smaller in size than a diameter of the inlet channel, and the angular channel is positioned in an angle with respect to the narrow channel.

In one implementation, the system for producing nanostructured material is configured such that extrusion through the narrow channel applies a first amount of strain on the sample of material. In one implementation, the system for producing nanostructured material is configured such that the first amount of strain severely deforms a nanostructure of the sample of material. In one implementation, the system for producing nanostructured material is configured such that extrusion through the angular channel applies a second amount of strain on the sample of material.

BRIEF DESCRIPTION OF THE DRAWINGS

Features of the subject technology are set forth in the appended claims. However, for purpose of explanation, several implementations of the subject technology are set forth in the following figures.

DETAILED DESCRIPTION

Figure 1:
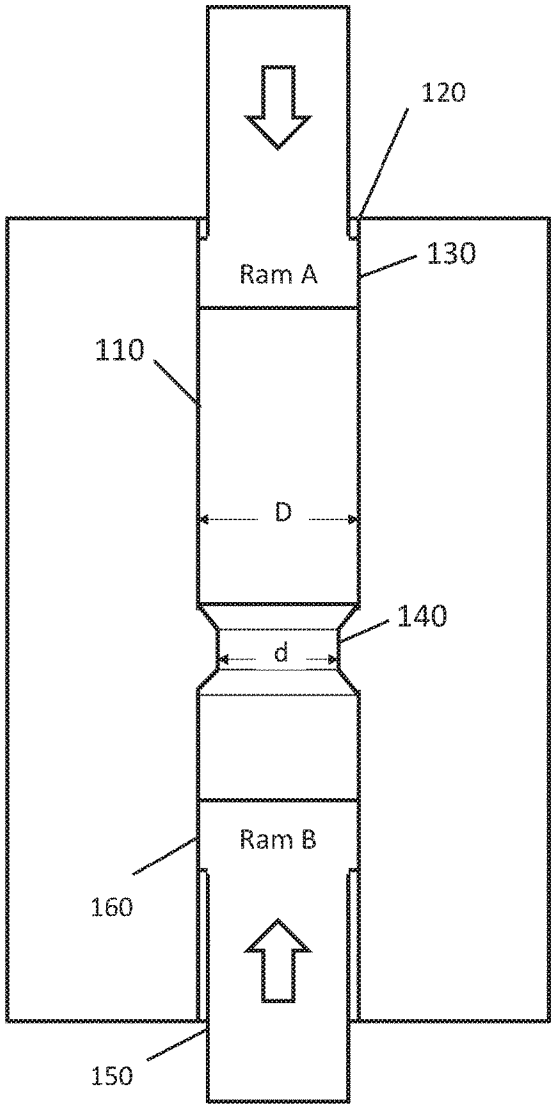
FIG. 1 illustrates a schematic drawing of an extrusion tool configured to produce nanostructure material through a cyclic extrusion compression process, according to an implementation.

In the following detailed description, numerous specific details are set forth by way, of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings. As part of the description, some of this disclosure's drawings represent structures and devices in block diagram form in order to avoid obscuring the invention. In the interest of clarity, not all features of an actual implementation are described in this specification. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" means that a particular feature, structure, or characteristic described in connection with the embodiment is included in at least one embodiment of the invention, and multiple references to "one embodiment" or "an embodiment" should not be understood as necessarily all referring to the same embodiment.

In recent years, there has been an increasing need, in many industries and in particular in the medical device industry, for use of materials that exhibit high strength. As a result, many techniques have been developed for strengthening various manufacturing materials. One of the best ways of increasing the strength of a material without changing its weight, is to reduce the size of the grains that make up the structure of the material. This is because, according to the following well-known Hall Petch equation reduction in grain size increases strength.

$$\sigma_y = \sigma_0 + Ad^{\frac{-1}{2}} \tag{1}$$

This equation indicates that the strength ($\sigma_y$) of a material is equal to its frictional stress ($\sigma_0$) plus a factor A, times the inverse of the square root of the size (d) of grains that make up the material. Thus, reducing the size of the grains that make up a material makes it stronger. That is one of the reasons nanostructured materials such as UFG metals exhibit highly desirable properties for use in many industries. In addition to high strength, these properties include high ductility and being easily moldable.

The most commonly used mechanisms for producing nanostructured materials such as LTG metals is through SPD processes. SPD refers to a group of techniques that involve applying very large strains to various materials to produce high defect density and UFG size materials. In general, in SPD processes, a significant amount of strain is applied to a piece of material which causes the material to develop UFG structure without causing any change in the final geometrical dimension and shape of the piece of material. Because of the advantages of nanostructured materials, there have been extensive theoretical and empirical studies done to develop and improve SPD processes. These studies have resulted in various SPD processes. Some of the most commonly, used SPD processes developed as a result of these studies include cyclic extrusion compression (CEC), cyclic expansion extrusion (CEE), accumulative roll-bonding (ARB), high pressure torsion (HPT), and sever torsion straining (STS). Although these processes offer various features, most of these mechanisms require multiple passes through the manufacturing device to achieve a desired strength and grain size. Moreover, all of the known SPD processes are time and labor intensive and as a result costly.

The CEC process, which is one of the most commonly used SPD processes, requires back pressure to produce the desired nanostructure material. This back pressure is obtained, in CEC, by applying a dual press which requires an expensive and complicated equipment. This leads to increase in manufacturing time and increased cost. To reduce the effects of this problem, the CEE process was developed, in recent years, as a modification of CEC. However, some back pressure is still needed in CEE. Moreover, the hydrostatic compressive stress in CEE is less than the CEC process. This is disadvantageous, as hydrostatic compressive stress is one of the main features of SPD processing in achieving nanostructured materials with desirable properties.

A solution is proposed here to solve these issues and more by providing an improved system and method of producing nanostructured materials by extruding the material through two deformation zones. The first zone consists of a cylindrical channel connected to a narrow channel through which the material is extruded which results in reducing its diameter. The second zone is an angular channel through which the compressed reduced diameter material is extruded to increase its diameter to the original diameter. This eliminates the need for a dual press to provide back pressure to the material in CEC. Moreover, because the angular channel applies additional strain, fewer passes through the system are needed to achieve a desire strength. As a result, the improved system and method provides an efficient mechanism of producing nanostructured materials that reduces manufacturing time and costs associated with production and yet produces higher quality products.

FIG. 1 illustrates an extrusion tool 100 depicting one implementation of a prior art CEC process. In one implementation, the extrusion tool 100 for performing a CEC process includes an inlet channel 120 for inputting a billet of material 110. The billet of material 110 is generally a cylindrical piece of metal having a dimeter D, that has been shaped to fit within the inlet channel 120. Once, the billet of material 110 enters the inlet channel 120, back pressure is applied to the billet 110 by a Ram A 130 to extrude the billet 110 through the narrow channel 140. The narrow channel 140 is configured such that it has a smaller diameter, d, than the diameter D of the billet. The smaller diameter applies pressure on the billet of material 110, thereby deforming all the regions of the microstructure of the billet and reducing its grain size, as it passes through the channel 140. Once the billet of material 110 passes the narrow channel 140, it enters the outlet channel 150. Because of the narrow diameter of the narrow channel 140, the process of extruding the billet through the narrow channel 140 reduces the diameter of the billet 110. As a result, the extruded billet 110 in the channel 150 may have a smaller diameter than its original diameter D To reverse this change in size, the CEC process utilizes a second ram, Ram B 160 in the outlet channel 150 to apply pressure to the billet 110. In one implementation, as a result of the pressure exerted by the ram 160, the billet of material 110 is extruded back to the inlet channel 120. Thus, the CEC process requires the use of dual press, which often involves a need for expense and complicated dual press equipment. Moreover, the process requires several passes through the CEC extrusion tool 100 to achieve a desired result. In one implementation, the amount of strain applied to the billet 110 each time it passes through the CEC extrusion tool 100 can be calculated by the following equation.

$$\varepsilon = 4\ln\frac{D}{d} \tag{2}$$

In equation (2), ε represents the amount of strain applied to the material, is the original diameter of the material and d is the diameter of the narrow channel 140. Thus, the amount of strain applied to the material relates to the original diameter of the material and the diameter of the narrow channel. The resulting strain is applied to the material each time it passes through the extrusion tool 100. As a result, multiple passes through the extrusion tool 100 may be required to achieve a required strain that produces a desired grain size.

To eliminate the need for a dual press and reduce the number of times a billet of material would need to pass through the extrusion tool, an improved extrusion tool and process may be utilized. FIGS. 2A-2D illustrate one implementation of an improved method and system of SPD for producing nanostructured materials. In one implementation, the improved extrusion tool 200 includes an inlet channel 220 having an open end through which a bulk cylindrical sample 210 enters the extrusion tool 200. In one implementation, the inlet channel 220 is a die input channel which is cylindrical in shape. In an alternative implementation, the inlet channel 220 takes a different shape. In one implementation, the inlet channel has a diameter which is close in size to the diameter D of the cylindrical sample 210. The cylindrical sample 210 may be cut shaped such that it fits snuggly into the inlet channel 220. In one implementation, the bottom end of the inlet channel 220 is connected to a top end of a narrow channel 240 having a narrower diameter than the diameter of the inlet channel 220.

Figures 2A, 2B, 2C, 2D:
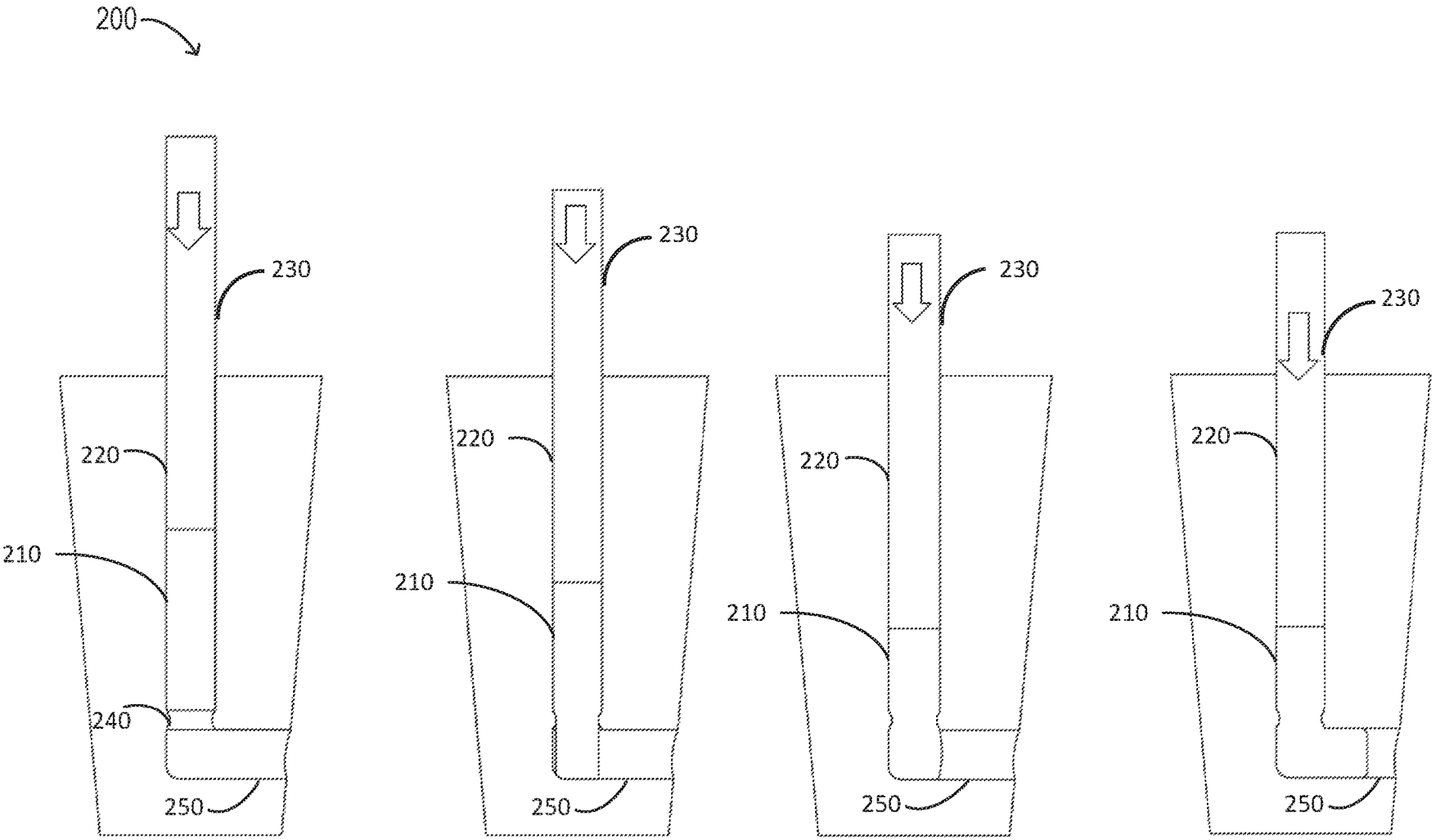
FIGS. 2A-2D illustrate schematic drawings of an improved extrusion tool configured to provide an improved method of producing nanostructure material, according to an implementation.

In one implementation, once the cylindrical sample 210 enters the inlet channel 220, a press 230 is used to apply pressure to the cylindrical sample 210, thus causing the cylindrical sample 210 to be extruded through the narrow channel 240, as illustrated in FIG. 2B. In one implementation, the press 230 is integrated into the inlet channel 220, such that the press 230 is a part of the inlet channel 220. Because of the narrow diameter of the narrow channel 240, after passing through the narrow channel 240, the sample 210 becomes narrower in diameter than its original diameter. This is shown in FIG. 2B. Moreover, because of the narrow diameter of the narrow channel, the reduced diameter sample 210 reaches the channel end compressed. As one of the important features of an SPD process is its ability to retain the original shape of a sample while deforming its microstructure, further action is needed at this stage to return the reduced size sample 210 to its original size and shape. This is provided in the improved extrusion tool 200 by the angular channel 250.

As FIG. 2C illustrates, continued application of pressure on the reduced size sample 210 causes it to enter the angular channel 250 to be laterally extruded. The angular portion of the angular channel 250 provides the required back pressure to compress the cylindrical sample 210 and increase its diameter to the original diameter, as shown in FIG. 2D. In this manner, a extrusion process similar to an CEC process is performed, but without the need to use a dual press equipment for providing the necessary back pressure to return the sample to its original size. Furthermore, extrusion through the angular portion of the angular channel applies addition strain on the sample, thereby causing it be further deformed.

Figure 3B:
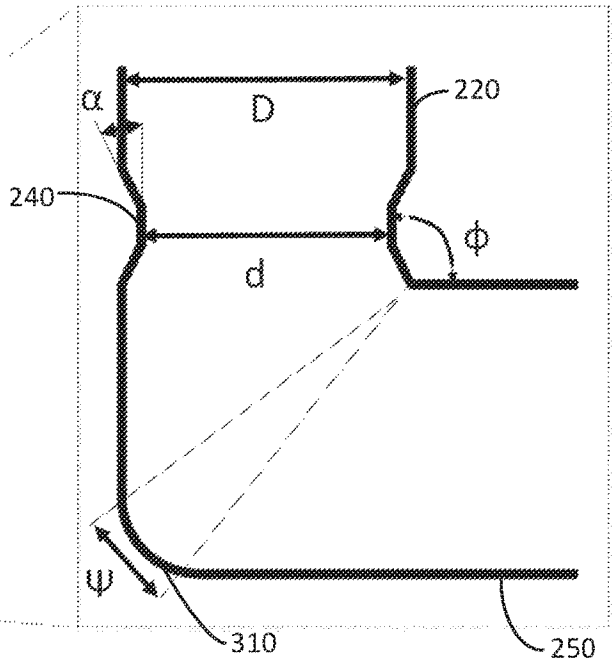
FIGS. 3A-3B illustrate schematic drawings of the cross-sectional view of the improved extrusion tool configured to provide an improved method of producing nanostructure material, according to an implementation.
Figure 3A:
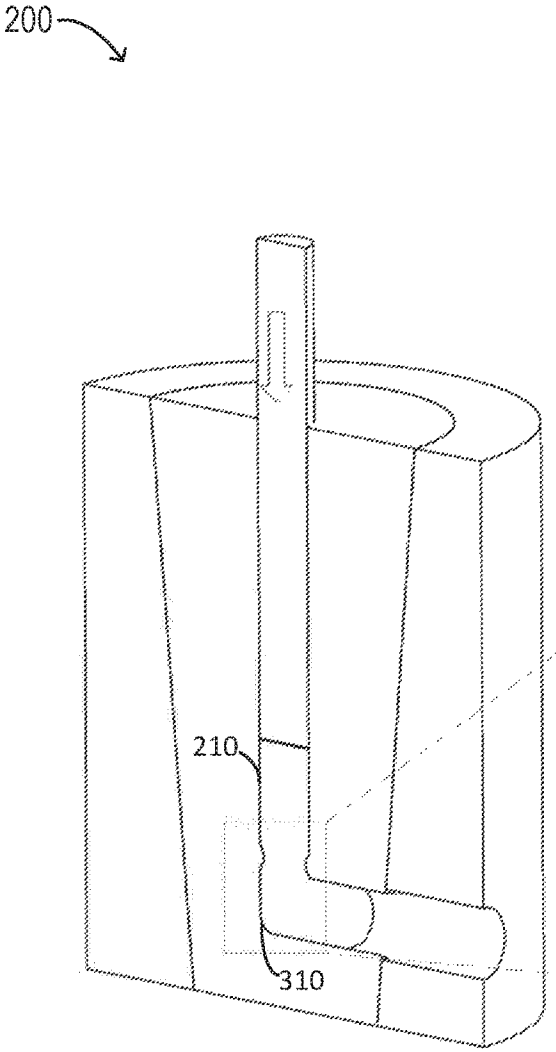

FIG. 3A illustrates a cross-sectional view of the improved extrusion tool 200 while the sample 210 is passing through the angular portion 310 of the angular channel 250, in one implementation. FIG. 3B illustrates an enlarged view of the portion of the extrusion tool 200 where the inlet channel 220 meets the narrow channel 240, and narrow channel 240 connects with the angular portion 310 of the angular channel 250. In one implementation, the narrow channel 240 has a diameter d which is smaller in size than the diameter D of the inlet channel 220. This provides the necessary strain on the sample as it passes through the narrow channel 220 to deform its microstructure. Once it passes through the narrow channel, the sample enters the angular portion 310 of the angular channel 250.

The angular channel 250 is located at an outer angle φ with respect to the narrow channel 240. In one implementation, the outer angle φ is approximately 90 degress, thus creating a lateral angle with respect to the narrow channel 240. In addition to the outer angle φ, the portion of the narrow channel 240 that meets the angular channel 250 has an inner angle ψ with respect to the angular channel 250. In one implementation, the inner angle ψ is smaller in size than the outer angle φ. Furthermore, in one implementation, the inlet channel 220 has an angle α with respect to the narrow channel 240.

In one implementation, passage through the angular portion 310 of the angular channel 250 causes the sample to be extruded angularly thus providing the necessary back pressure to return the sample to its original size. Furthermore, passing through the angular portion 310 applies a certain amount of strain on the sample causing it to be further deformed. In one implementation, the amount of strain applied to the sample while passing through the angular potion can be calculated according to the following equation.

$$\varepsilon = \frac{1}{\sqrt{3}}\left\{2\cot\left(\frac{\varphi}{2}+\frac{\psi}{2}\right)+\psi\csc\left(\frac{\varphi}{2}+\frac{\psi}{2}\right)\right\} \tag{3}$$

Thus, a sample 210 passing through the improved extrusion tool 200 receives a first amount of strain while passing through the narrow channel 240 and a second additional amount of strain while passing through the angular portion 310. As a result, the total amount of strain applied to the sample as it passes through the extrusion tool 200 is the total sum of the strain applied by the narrow channel 240 and the angular portion 310. This can be calculated by the following equation.

$$\varepsilon = \frac{1}{\sqrt{3}}\left\{2\cot\left(\frac{\varphi}{2}+\frac{\psi}{2}\right)+\psi\csc\left(\frac{\varphi}{2}+\frac{\psi}{2}\right)\right\}+4\ln\frac{D}{d} \tag{4}$$

This causes in an increase in the amount of shear strain applied to the sample in each pass, thus decreasing the number of passes necessary to achieve a desired strain. As a result, the improved extrusion tool 200 provides an efficient method of extrusion of nanostructured material that eliminates the need for dual press back pressure while reducing the amount of time and labor required to achieve a desired grain size.

Figure 4:
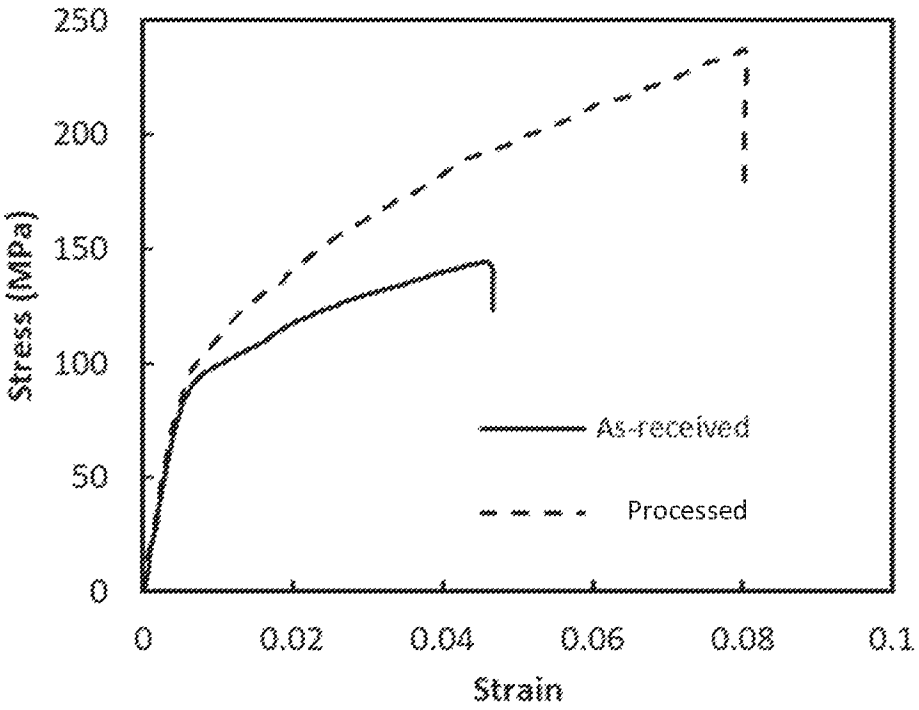
FIG. 4 illustrates a diagram of properties of an unprocessed sample as compared to properties of a sample processed according to an improved method of producing nanostructure material, in one implementation.

To investigate the applicability of the improved method of producing nanostructured materials, the method was applied to a sample piece of magnesium alloy (AZ91 alloy). Microstructure and mechanical properties of the resulting processed sample were then studied to determine the effects of the improved method. FIG. 4 illustrates the true tensile stress/strain curves for an unprocessed sample as compared to a processed sample. As depicted, the as received unprocessed sample had low ductility. In one implementation, this can be a result of the limited slip system at room temperature and dendritic structure of the sample along grain boundaries. However, a remarkable improvement in strength is achieved for the sample after being processed. In the implementation shown, the stress was increased from an initial value of 144 MPa to 234 MPa resulting in an increase of about 63%. This demonstrates that the improved method of producing nanostructured materials results in considerable reduction in grain size while it improves the homogeneous distribution of the grains. This leads to significant increase in the strength of the processed sample.

Additionally, FIG. 4 illustrates that ductility was significantly increased from about 4% for the unprocessed sample to about 8% for the processed sample. This is because applying strain through the improved method of producing nanostructured materials can lead to a homogeneous distribution and precipitation of b phase in the microstructure. Another reason responsible for better ductility can be a higher amount of hydrostatic compressive stress produced in the improved method of producing nanostructured materials. In general, hydrostatic compressive stress in the improved method of producing nanostructured materials is higher than previously known SPD processes. Higher hydrostatic pressure results in a smaller number of cracks and thus fewer propagation of cracks and micro-voids which increases the ductility of the sample. Therefore, the increased strength of the processed sample could be at least partly attributed to the increased hydrostatic pressure applied by the improved method of producing nanostructured materials. Higher hydrostatic pressure can also lead to improving plasticity of hard to form metals such as magnesium and titanium and can thus help to activate different slip systems.

In one implementation, the improved method of producing nanostructured materials also results in increased microhardness which is consistent with the microstructure refinement and b phase precipitation of the processed sample. This exceptional mechanical property may also be related to the high hydrostatic pressure of the improved method of producing nanostructured materials besides high shear strain of the angular channel.

Accordingly, the improved method and system of producing nanostructured materials provides an efficient mechanism for extruding a material through two deformation zones to achieve a desired grain size and strength without the need to use dual press and with reduced number of passes necessary to achieve the desired result.

The separation of various components in the examples described above should not be understood as requiring such separation in all examples, and it should be understood that the described components and systems can generally be integrated together in a single packaged into multiple systems.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations for the purpose of streamlining the disclosure. This method of disclosure is not to be interpreted as reflecting an intention that the claimed implementations require more features than are expressly recited in each claim. Rather, as the following claims reflect, inventive subject matter lies in less than all features of a single disclosed implementation. Thus the following claims are hereby incorporated into the Detailed Description, with each claim standing on its own as a separately claimed subject matter.

What is claimed is:

1. A method of producing nanostructured material comprising:

providing a sample of material;

placing the sample of material into an extrusion tool, the extrusion tool including a first channel, a narrow channel and an angular channel, the narrow channel being positioned in between the first channel and the angular channel with a top end of the narrow channel being connected to a lower end of the first channel and a bottom part of the narrow channel being connected to a top end of the angular channel;

applying pressure on the sample of material to extrude the sample through the narrow channel and into the angular channel; and forcing the extruded sample of material to further extrude through the angular channel, wherein:

the first channel, the narrow channel and the top end of the angular channel are collinear, the angular channel includes a curved portion that connects the top end of the angular channel to a linear portion of the angular channel, the angular channel is positioned at an outer angle with respect to the narrow channel, the bottom part of the narrow channel is positioned at an inner angle with respect to the angular channel, the inner angle is smaller in size than the outer angle, extrusion through the narrow channel reduces a diameter of the sample of material and extrusion through the angular channel increases the reduced diameter without a need for applying back pressure, extrusion through the narrow channel applies a first amount of strain on the sample of material, extrusion through the angular channel applies a second amount of strain on the sample of material, and a total amount of strain applied to the sample of material equals the first amount of strain plus the second amount of strain.

2. The method of producing nanostructured material of claim 1, wherein the sample of material has a cylindrical shape.

3. The method of producing nanostructured material of claim 1, wherein extrusion through the angular channel increases the diameter of the sample of material back to an original diameter.

4. The method of producing nanostructured material of claim 1, wherein the first amount of strain severely deforms a nanostructure of the sample of material.

5. The method of producing nanostructured material of claim 1, wherein the second amount of strain severely deforms a nanostructure of the sample of material.

6. The method of claim 1, wherein a desired grain size and strength for the nanostructured material is achieved without a need to use a dual press.

7. A system for producing nanostructured material comprising:

an inlet channel having a first end for inputting a sample of material and a second end;

a narrow channel for extruding the sample of material, the narrow channel having a top end and a bottom end, the top end being connected to the second end of the inlet channel; and an angular channel for further extruding the sample of material, the angular channel having a top end connected to the bottom end of the narrow channel;

wherein:

the inlet channel, the narrow channel and the top end of the angular channel are collinear, the angular channel includes a curved portion that connects the top end of the angular channel to a linear portion of the angular channel, the narrow channel has a diameter which is smaller in size than a diameter of the inlet channel, the angular channel is positioned at an outer angle with respect to the narrow channel, the bottom end of the narrow channel is positioned at an inner angle with respect to the angular channel, the inner angle is smaller in size than the outer angle, extrusion through the narrow channel reduces a diameter of the sample of material, while extrusion through the angular channel increases the reduced diameter without a need for applying back pressure.

8. The system of claim 7, wherein the linear portion of the angular channel has an open end which acts as an outlet.

9. The system of claim 7, wherein the outer angle is 90 degrees.

10. The system of claim 7, wherein extrusion through the narrow channel applies a first amount of strain on the sample of material.

11. The system of claim 10, wherein the first amount of strain severely deforms a nanostructure of the sample of material.

12. The system of claim 10, wherein extrusion through the angular channel applies a second amount of strain on the sample of material.

13. The system of claim 12, wherein the second amount of strain severely deforms a nanostructure of the sample of material.

14. The system of claim 12, wherein a total amount of strain applied to the sample of material equals the first amount of strain plus the second amount of strain.

* * * * *